US011213842B2

(12) United States Patent
Hoefte et al.

(10) Patent No.: US 11,213,842 B2
(45) Date of Patent: Jan. 4, 2022

(54) SPRAY DISPENSER WITH UNITARY SPRAYER COVER AND METHOD OF ASSEMBLING A SPRAY DISPENSER

(71) Applicant: The Procter & Gamble Company, Cincinnati, OH (US)

(72) Inventors: Paulus Antonius Augustinus Hoefte, Astene (BE); Pieter Paul Dirk Jenny Maria Van Den Bergh, Sint-Martens-Latem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/249,025

(22) Filed: Jan. 16, 2019

(65) Prior Publication Data

US 2019/0232311 A1 Aug. 1, 2019

Related U.S. Application Data

(60) Provisional application No. 62/623,683, filed on Jan. 30, 2018.

(51) Int. Cl.

| | |
|---|---|
| ***B05B 11/00*** | (2006.01) |
| ***B05B 15/65*** | (2018.01) |
| ***B05B 15/14*** | (2018.01) |

(52) U.S. Cl.

CPC ..... *B05B 11/3009* (2013.01); *B05B 11/0008* (2013.01); *B05B 11/3042* (2013.01); (Continued)

(58) Field of Classification Search

CPC ..... B05B 11/3009; B05B 15/65; B05B 15/14; B05B 11/0008; B05B 11/3042; B05B 11/3011

See application file for complete search history.

(56) References Cited

U.S. PATENT DOCUMENTS

| | | | |
|---|---|---|---|
| 4,161,288 A | 7/1979 | Mckinney | |
| 4,506,805 A | 3/1985 | Marcon | |

(Continued)

FOREIGN PATENT DOCUMENTS

| | | | | |
|---|---|---|---|---|
| EP | 1103308 B1 | | 10/2007 | |
| JP | H1057853 | * | 5/2000 | ..... B05B 11/3014 |

OTHER PUBLICATIONS

Machine Translation of JPH1057853 from EPO, epo.org.*

Extended European Search Report and Search Opinion; Application No. 19153422.1 ; dated Jul. 3, 2019; 10 pages.

*Primary Examiner* — Jeremy Carroll

(74) *Attorney, Agent, or Firm* — Melissa Krasovec

(57) ABSTRACT

A spray dispenser operably connectable to a container for dispensing fluid from the container. The spray dispenser includes a pump, a shroud disposed about at least a portion of the pump. The shroud has a shroud bottom edge defining an open end. A nozzle is in fluid communication with an outlet of the pump, the nozzle adjacent to an opening in the shroud and extending outwardly therefrom. A unitary sprayer cover having a first portion spaced apart from the open end of the shroud to define a shroud top of the shroud. The unitary sprayer cover further includes a second portion having a proximal end connected to the first portion and a distal end disposed away from the first portion. The second portion extends from the shroud to at least partially surround the nozzle.

8 Claims, 13 Drawing Sheets

(52) U.S. Cl.
CPC ..... *B05B 15/14* (2018.02); *B05B 15/65* (2018.02); *B05B 11/3011* (2013.01)

(56) References Cited

U.S. PATENT DOCUMENTS

| | | | | | |
|---|---|---|---|---|---|
| 4,624,413 | A | * | 11/1986 | Corsette | B05B 1/3431 239/333 |
| 5,297,701 | A | | 3/1994 | Steijns et al. | |
| 5,431,345 | A | * | 7/1995 | Lund | B05B 7/0018 239/329 |
| 5,575,407 | A | * | 11/1996 | Foster | B05B 1/3431 222/324 |
| 5,775,594 | A | * | 7/1998 | Tasaki | B05B 7/0068 239/343 |
| 6,364,171 | B1 | | 4/2002 | Chalupsky et al. | |
| 2002/0014274 | A1 | * | 2/2002 | Brozell | B05B 11/0097 141/2 |
| 2008/0223881 | A1 | | 9/2008 | Clynes | |
| 2010/0308081 | A1 | | 12/2010 | Waitz | |
| 2015/0165454 | A1 | | 6/2015 | Hopper et al. | |
| 2017/0348716 | A1 | * | 12/2017 | Fujiwara | B05B 11/305 |

* cited by examiner

SPRAY DISPENSER WITH UNITARY SPRAYER COVER AND METHOD OF ASSEMBLING A SPRAY DISPENSER

FIELD OF THE INVENTION

The present invention relates to devices and systems for dispensing a liquid composition, and particularly to spray dispensers for dispensing liquid compositions, a method of assembly of a spray dispenser and a liquid dispensing product.

BACKGROUND OF THE INVENTION

Trigger actuated spray dispensers for spraying cleaning compositions such as fabric care compositions, dishwashing detergents, hand soap, and surface cleaners are known. Such cleaning compositions are generally contained within bottles attached to the trigger actuated sprayers. Traditional trigger spray dispensers may have a nozzle assembly attached to a shroud housing a pump, and a trigger having for example, a trigger lever, underneath the nozzle assembly. The shroud is then attached to a container holding the cleaning composition. Examples of trigger actuated spray dispensers and nozzle assemblies are disclosed in US Patent Application Publication No. US 2008/0223881 A1, U.S. Pat. No. 5,297,701, and EP Patent No. EP 1,103,308 B1. A conventional nozzle assembly may comprise a nozzle housing integral with a nozzle cylinder protruding from the center of the housing. A nozzle orifice for spraying is provided in the center of the nozzle cylinder. A conventional method of assembling the nozzle assembly in a spray dispenser may include a step of attaching the nozzle assembly to a discharge outlet of the pump housed in the shroud.

However, damage to the nozzle assembly may occur during manufacturer. For example, impact to the nozzle during manufacturing or attaching the nozzle assembly may cause the nozzle orifice and nozzle flow passages of the nozzle to become deformed. As a result, the spray pattern may become irregular thereby affecting its performance. Accordingly, there is a need to have a spray dispenser that can be assembled quickly while minimizing risks of damage to the nozzle.

SUMMARY OF THE INVENTION

The present invention relates to a spray dispenser operably connectable to a container for dispensing fluid from the container, the spray dispenser comprising:

(i) a pump, (ii) a shroud disposed about at least a portion of the pump, the shroud having a shroud bottom edge defining an open end;

(iii) a nozzle in fluid communication with the pump, the nozzle adjacent to an opening in the shroud and extending outwardly therefrom; and (iv) a unitary sprayer cover having:

a first portion joined to and covering at least a portion of the open end of the shroud; and a second portion having a proximal end connected to the first portion and a distal end disposed away from the first portion; the second portion extending from the shroud to at least partially surround the nozzle.

DETAILED DESCRIPTION OF THE INVENTION

It has been found that the design of parts making up a spray dispenser play an important role in enabling ease of assembling the spray dispenser and preventing damage to the nozzle at the same time. Specifically, damage to a nozzle orifice of the nozzle may cause the nozzle orifice and nozzle flow passages of the nozzle to become distorted. Distortion of nozzle flow passages may result in a spray pattern of the spray dispenser to become irregular thereby affecting its performance. It has also been surprisingly found that providing a unitary sprayer cover designed to be attached to a shroud and having a part that at least partially surrounds the nozzle can help to minimize contact with the nozzle during assembly which can prevent accidental damage to the nozzle.

The present invention relates to a spray dispenser, and a method of assembling a spray dispenser. The spray dispenser is suitable for various uses, including but not limited to, spraying a liquid composition, such as liquid detergent, in a liquid state, an atomized state or a foamed state. The spray dispenser may be attached to a bottle or a container containing the liquid composition to form a liquid dispensing product. The following description referring to the figures is intended to provide non-limiting examples of the present invention. It should be understood that other embodiments are contemplated, including embodiments with additional, fewer or alternative features and different combinations of the features shown and/or described.

Figure 1:
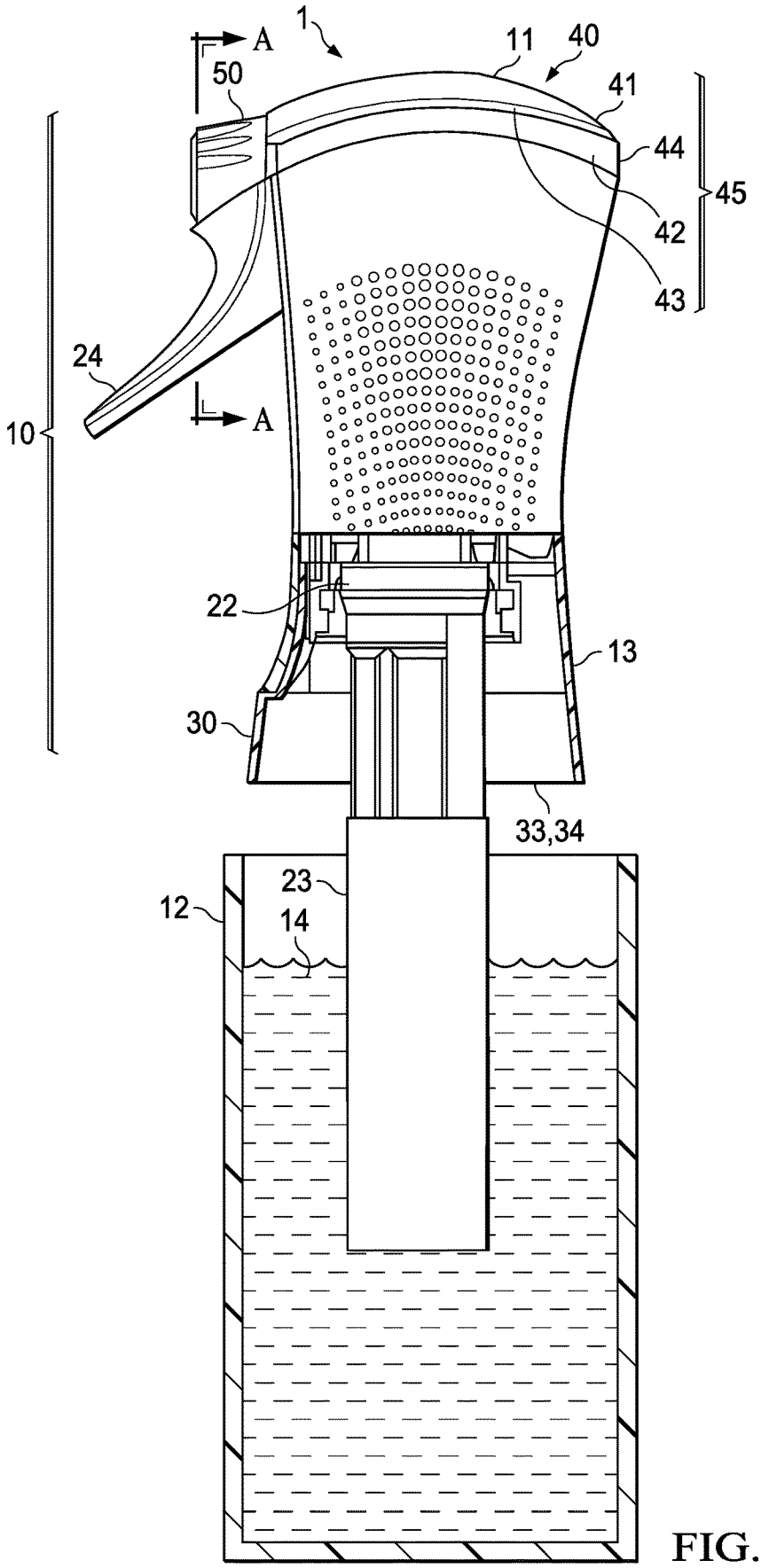
FIG. 1 is a side schematic view of a liquid dispensing product according to the present invention.

FIG. 1 is a side schematic view of a liquid dispensing product 1 comprising a spray dispenser 10 and a container 12 containing a liquid composition 14 before assembly. The liquid composition 14 may be a detergent composition adapted for cleaning including but not limited to cleaning dishes, household surfaces such as tables, walls, glass windows, fabric freshening or cleaning vehicles. The spray dispenser 10 comprises a pump 22 and a trigger 24 operatively engaged with the pump 22. A shroud 30 may be disposed about at least a portion of the pump 22. The shroud 30 may comprise a shroud top 11, a shroud body 13 having an inner wall 31 for housing the at least a portion of the pump 22, and a longitudinal axis 32 extending centrally in the inner wall 31. The shroud 30 further comprises a shroud bottom edge 33 defining an open end 34. In FIG. 1, the shroud 30 is designed so that an inlet 23 of the pump 22 extends through the open end 34 into the container 12. A sprayer cover 40 is spaced apart from the shroud bottom edge 33 of the shroud body 13 to define the shroud top 11.

The sprayer cover 40 may comprise a top surface 41, a pair of side walls 42 extending from opposite edges 43 of the top surface 41, and a rear wall 44 disposed intermediate the side walls 42 to define a first portion 45 of the sprayer cover 40. The sprayer cover 40 may also include a second portion 49 (shown in FIG. 3) projecting outwardly from the first portion 45 to define a nozzle housing 498 for a nozzle 26 which will be described later with reference to FIG. 2. The spray dispenser 10 may further comprise a spout 50 for housing the second portion 49 and the nozzle 26. The spout 50 will be described in further detail with reference to FIGS. 2 and 8.

A technical effect of the spray dispenser 10 according to the present invention is that having a sprayer cover 40 including the second portion 49 for at least partially surrounding nozzle 26 is that the risk of damage to the nozzle 26 may be reduced during manufacturing/assembly/transport/trade/and/or use. Further, the sprayer cover 40 can also be manufactured as a single piece to reduce manufacturing complexity and can be assembled easily over the shroud 30. Also, the second portion 49 can be sized and configured to fit a number of different sizes and types of nozzles so as to allow each change over to different nozzles during production of spray dispensers 10. Further, as the first portion 45 is integral with the second portion 49, it requires one piece less to mould, saving capital costs accordingly and also reduces the chance of the second portion 49 getting lost due to poor assembling, i.e. the second portion 49 cannot fall off entirely and be misplaced, thereby reducing a risk of leaving the nozzle 26 (which is a sensitive part as explained hereinbefore) unprotected.

Figure 2:
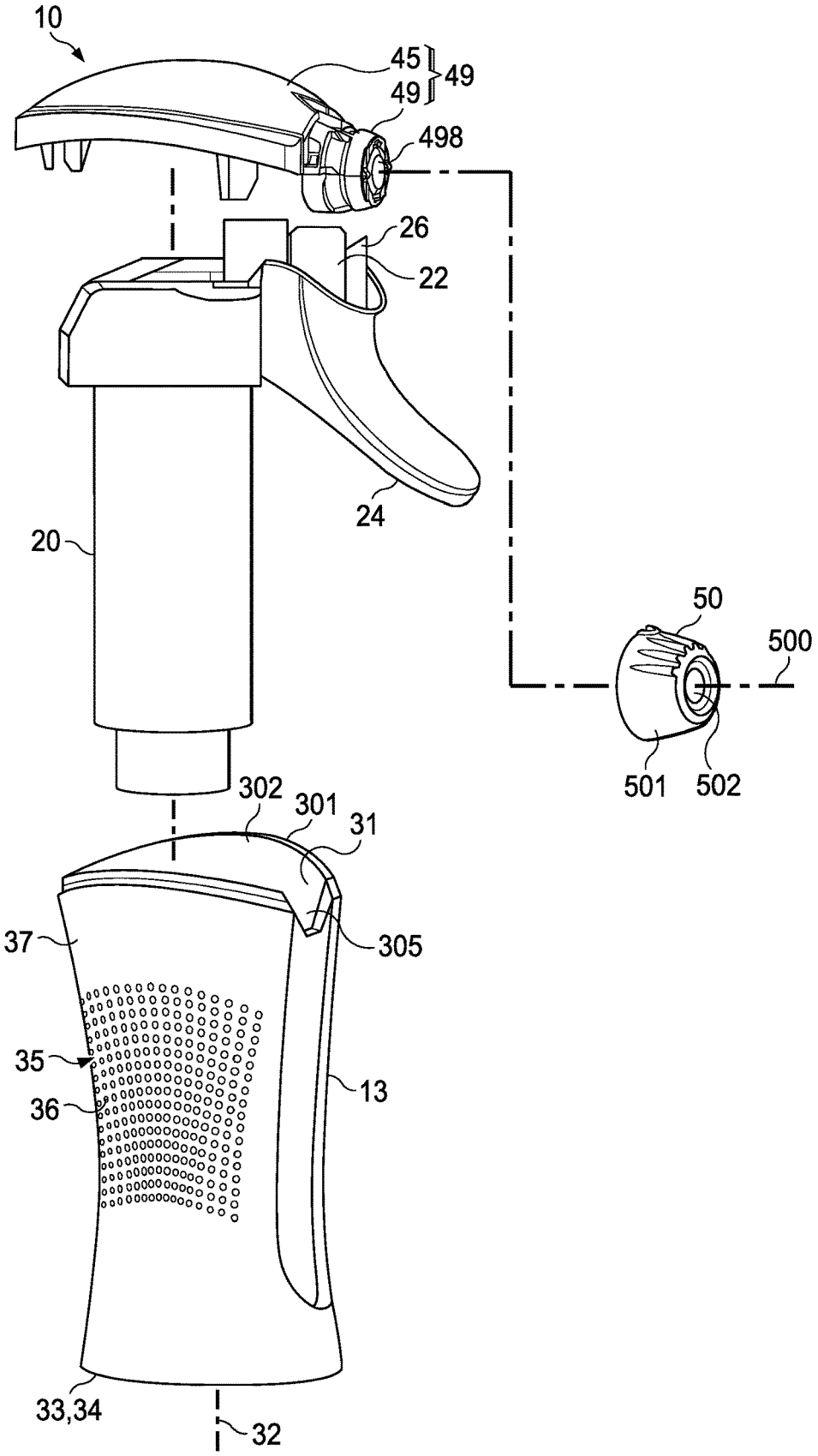
FIG. 2 is an exploded assembly view of components of the spray dispenser of FIG. 1.

The sprayer cover 40 may be integral with the shroud body 13 to form a unitary shroud as shown in FIG. 1. The sprayer cover 40 may also be a separate piece from the shroud body 13 such that the shroud 30 forms a two-piece structure as shown in FIG. 2. For the purposes of this disclosure, but without intending to limit the scope of the invention, the shroud 30 is described as a two-piece structure.

Spray Dispenser

Figure 10:
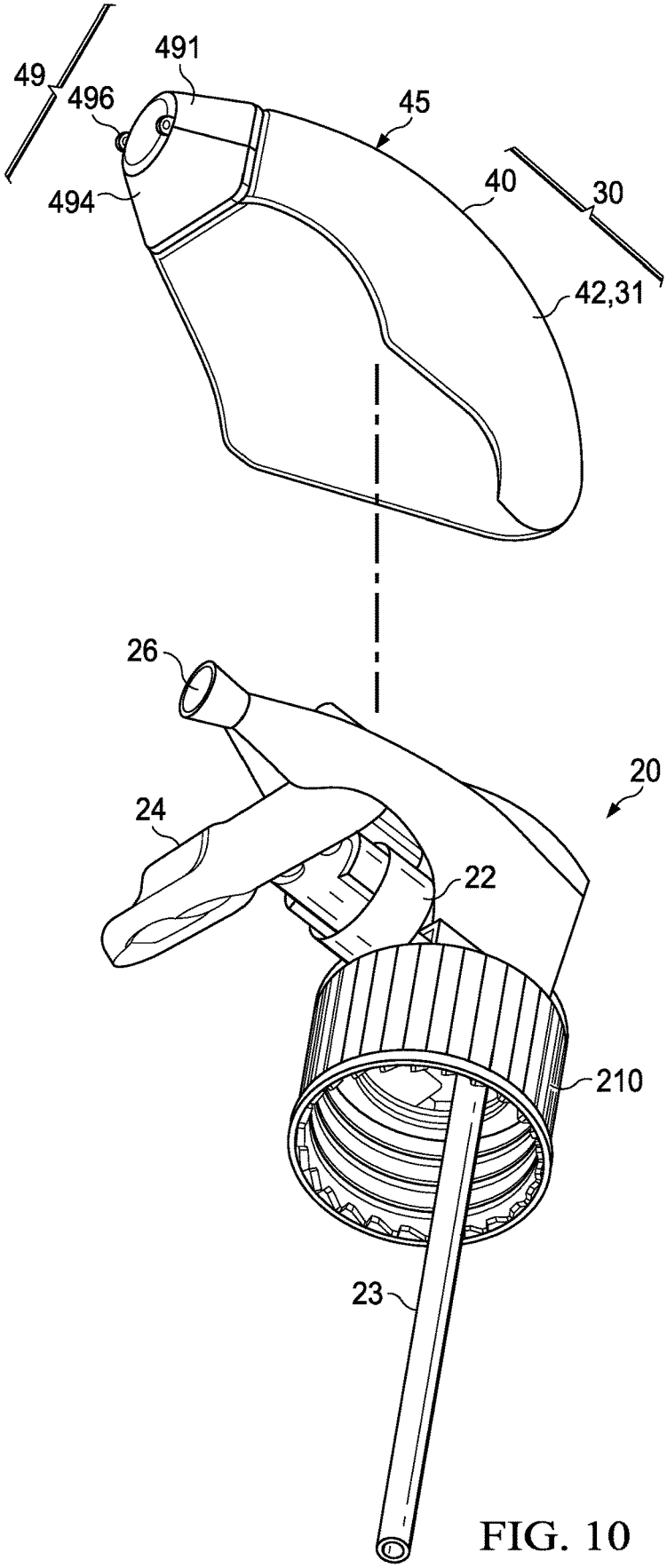
FIG. 10 is a side perspective view of components of a sprayer dispenser according to the present invention.

FIG. 2 shows components of a spray dispenser 10 according to the present invention wherein the sprayer cover 40 is configured to be joined to the shroud body 13 so as to form the shroud 30 (as shown in FIG. 1), i.e. the shroud 30 is a two-piece structure with the shroud body 13 and the sprayer cover 40 being two separate pieces. The shroud 30 may have a curved exterior profile for aesthetic appeal and to fit a person's grasp. The shroud 30 may further comprise a gripping portion 35 for ease of handling the liquid dispensing product 1. The gripping portion 35 may comprise a plurality of protruded bumps 36 on the exterior 37 of the shroud 30 wherein the bumps 36 may be configured to provide a textured feel and increased friction during handling of the liquid dispensing product 1 thereby improving a gripping action. For example, having an improved gripping action may facilitate users when pressing of the trigger 24 to spray the liquid composition 14 on a target surface. However, it will be appreciated that the shroud 30 may also be designed differently (such as shown in FIG. 10) to be shorter in length relative to the shroud 30 of FIG. 1 and the gripping portion 35 is disposed on the screw top neck 210.

Figure 3:
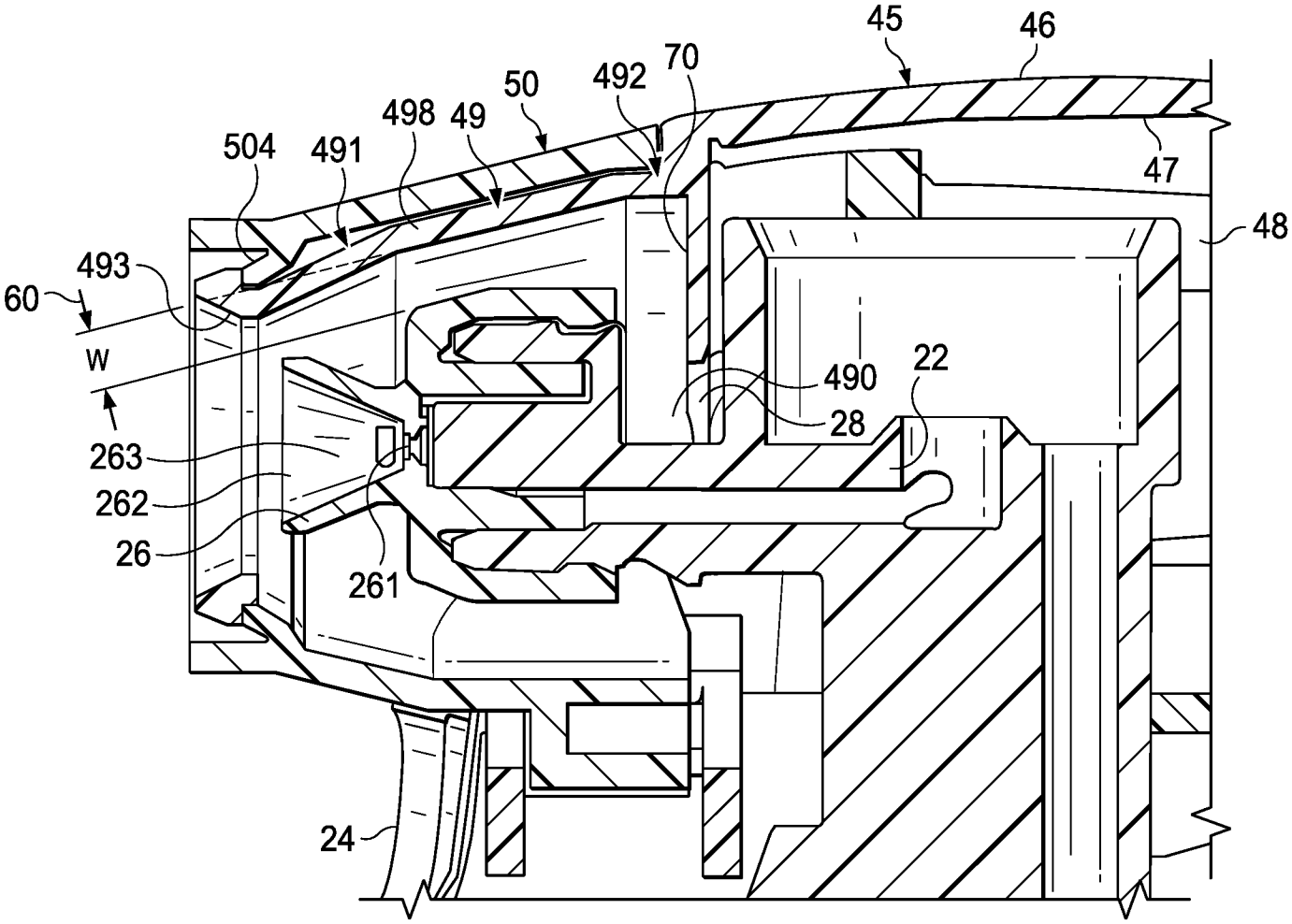
FIG. 3 is a side cross section view of a spray dispenser of the liquid dispensing product of FIG. 1 taken at line A-A.

Referring to FIG. 2, the shroud body 13 may comprise a top edge 301 defining a second open end 302 in the inner wall 31 for receiving the sprayer cover 40 wherein the second open end 302 is spaced apart from the open end 34 at the shroud bottom edge 33 defining a length of the shroud body 13. The shroud 30 may further comprise an opening 305 in the inner wall 31 for receiving a nozzle 26. The trigger 24 and the pump 22 may be comprised in a trigger assembly 20. The nozzle 26 may form part of the trigger assembly 20. In FIG. 3, the nozzle 26 is arranged to be in fluid communication with a pump discharge outlet of the pump 22 and the trigger assembly 20 is connected to the sprayer cover 49 by inserting the nozzle 26 into a receiving bore 490 within the second portion 49. As shown in FIG. 2, the spout 50 may comprise a cylindrical-like structure having a longitudinal axis 500, a spout outer surface 501 and a spout inner surface 502. The spout 50 may be mounted to the second portion 49 such that at least a part of the spout inner surface 502 engages at least a part of the second portion 49. Depending on the design of the spout inner surface 502 and the second portion 49, the spout 50 may be fixed or movable relative to the second portion 49 to perform a variety of design functions including but not limited to spray pattern selection, closing or opening of the nozzle 26 or locking of the trigger 24. The spout 50 may be rotatable about a central longitudinal axis 500 thereof between a discharge unlocked position and a discharge locked position, which will be further described with reference to FIGS. 8, 9A, 9B, and 9C. The spout 50 may be made of a thermoplastic material, a composite material, or any material suitable for molding or forming.

FIG. 3 shows a partial side section view of the sprayer cover 40 with the nozzle 26 of the spray dispenser 10 as shown in FIG. 1 taken along the line A-A. As shown in FIG. 3, the nozzle 26 includes a nozzle inlet 261 at a proximal end adjacent to a pump discharge outlet of the pump 22 and a nozzle outlet 262 spaced apart from the nozzle inlet 261 defining a nozzle flow pathway 263. The trigger 24 may be operatively connected to the pump 22 such that upon assembly of the spray dispenser 10 and actuation of the trigger 24, the liquid composition 14 (shown in FIG. 1) may exit the spray dispenser 10 as it moves from the nozzle outlet 262 through the nozzle flow pathway 263.

Sprayer Cover

Figure 4:
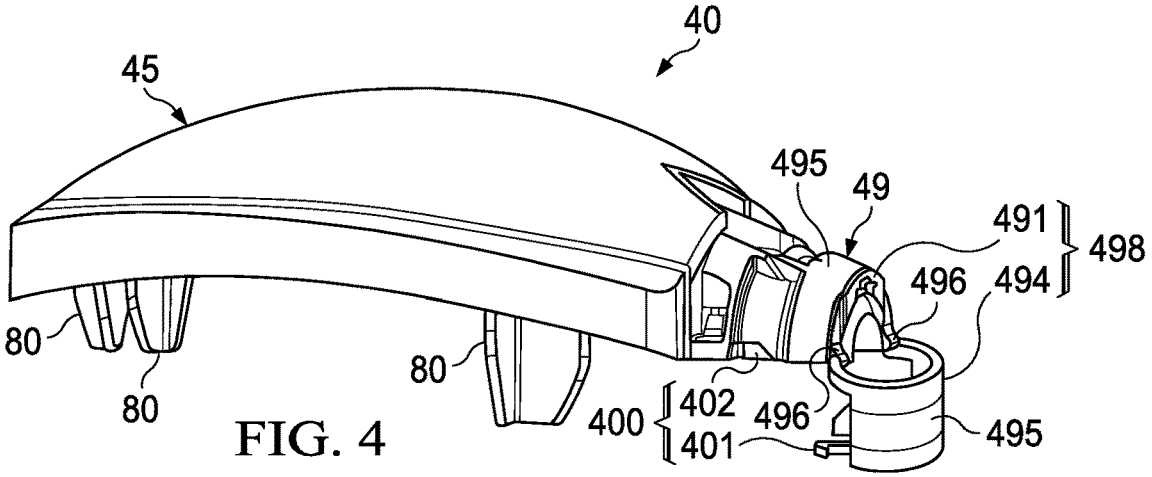
FIG. 4 is a perspective view of a sprayer cover according to the present invention.
Figure 5:
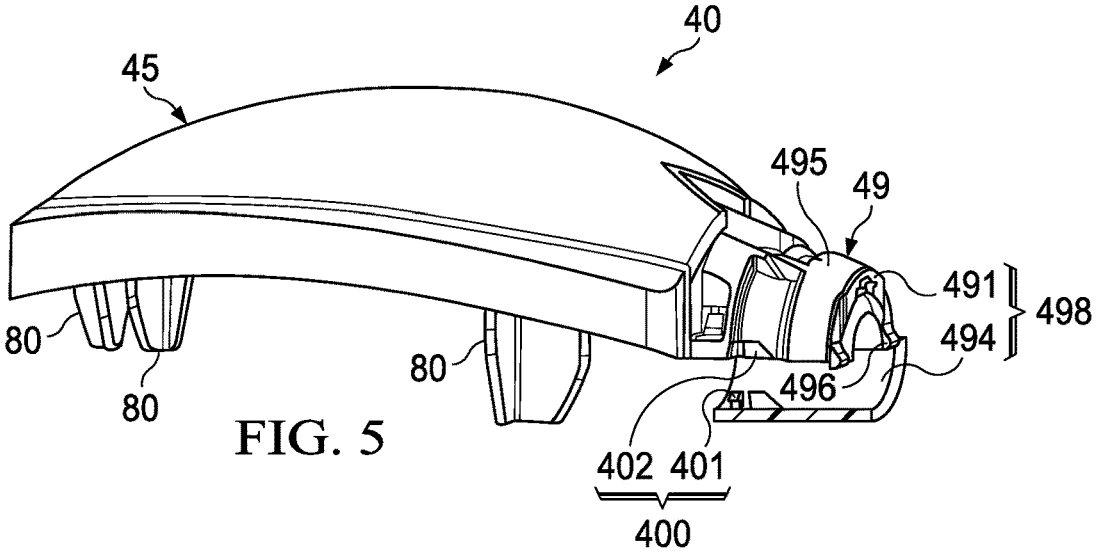
FIG. 5 is a perspective view of a sprayer cover according to the present invention.
Figure 6:
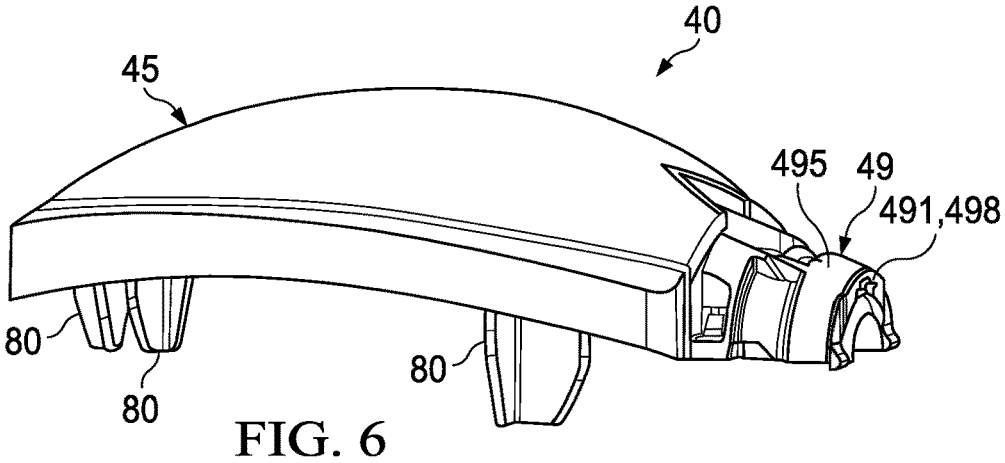
FIG. 6 is a perspective view of a sprayer cover according to the present invention.

Referring to FIG. 3, the sprayer cover 40 may comprise a cover outer surface 46 and a cover inner surface 47 which have corresponding profiles shaped to define an interior volume 48 of the sprayer cover 40. The outer and inner surfaces 46, 47 may be curved for aesthetic appeal. As shown in FIG. 3, the second portion 49 of the sprayer cover 40 projects outwardly from the first portion 45 to define a nozzle housing 498 at least partially surrounding the nozzle 26. Preferably, the second portion 49 is not in contact with the nozzle 26 to provide a nozzle housing 498 that does not contact the nozzle 26. Also, it is generally preferred that the second portion 49 be formed separately from the nozzle 26. This is in contrast to conventional nozzle housings where the nozzle and the nozzle housing are formed as a single component that is attached separately to the pump outlet of a conventional trigger assembly. The second portion 49 may be a two-part structure as shown in FIGS. 4 and 5 or a single-part structure as shown in FIG. 6. For the purposes of this disclosure, but without intending to limit the scope of the invention, the second portion 49 is described as a two-part structure. The sprayer cover 40 may be formed of a single piece of thermoplastic material in a molding process or any other suitable material.

Referring to FIG. 3, the second portion 49 of the sprayer cover 40 may comprise a first nozzle housing part 491 having a proximal end 492 connected to the first portion 45 and a distal end 493 disposed away from the first portion 45, the first nozzle housing part 491 at least partially surrounding the nozzle 26. The spout 50 may comprise one or more protrusions 504 sized for engaging the distal end 493 so as to attach the spout 50 to the second portion 49 of the sprayer cover 40. There may be a gap 60 between the nozzle 26 and the second portion 49 of the sprayer cover 40 such that the sprayer cover 40 and the nozzle 26 are not in contact. The size of the gap 60 may be uniform and constant along a radial direction of the nozzle 26. The gap 60 may comprise a gap width W configured to prevent inadvertent interference of the sprayer cover 40 with the nozzle 26 during assembly/transport/trade/use of the dispenser product or during actuation of the trigger 24 thereby minimizing risks of damage of the nozzle 26. Specifically, the sprayer cover 40 may comprise one or more projections 70 extending from the inner surface 47 wherein a cover projection 70 may be sized to abut or engage with at least a part 28 of the trigger assembly 20 so to provide the gap 60 as shown in FIG. 3.

Figure 7A:
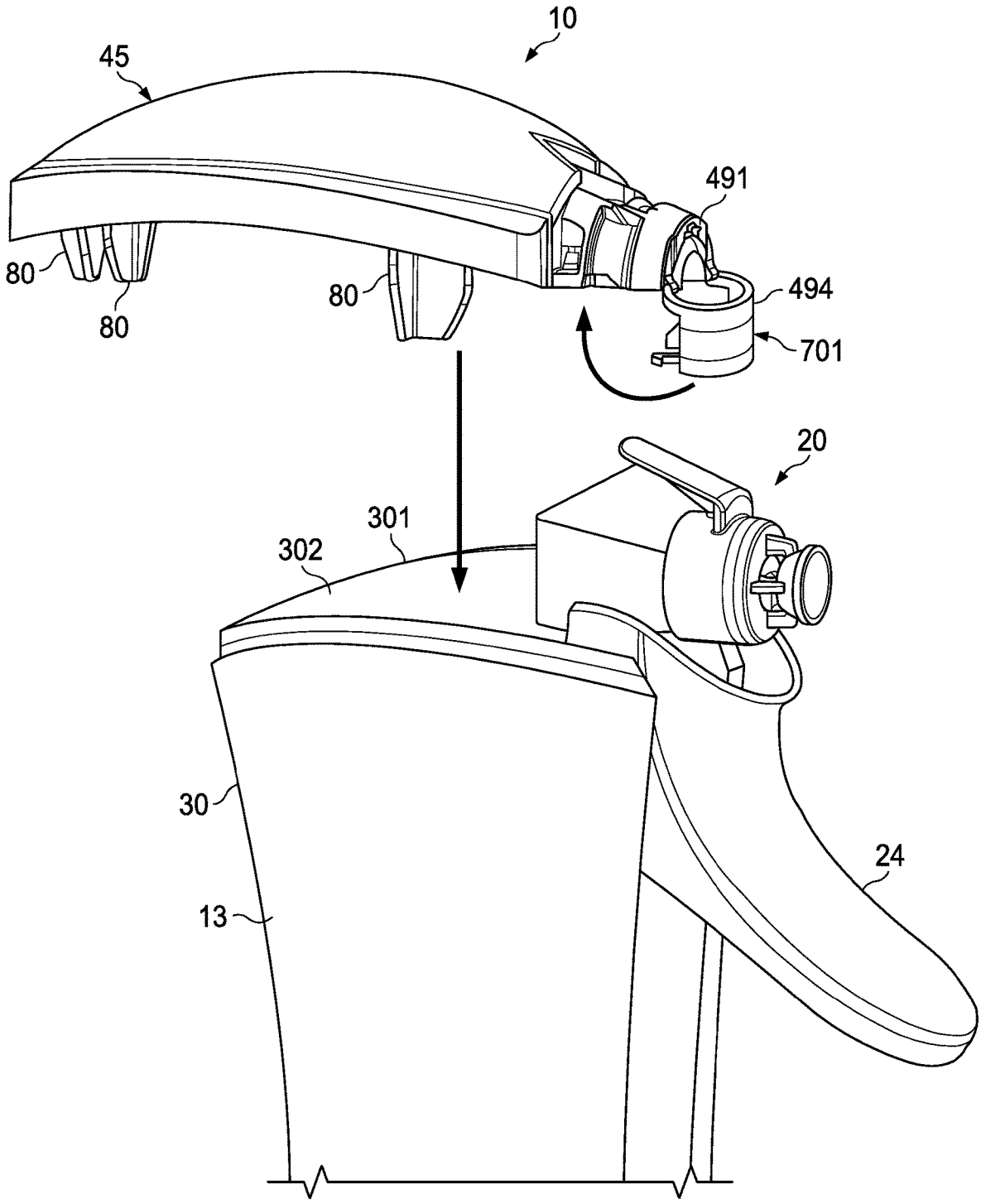
FIG. 7A is a side perspective view of components of a spray dispenser of FIG. 2 before assembly.
Figure 7B:
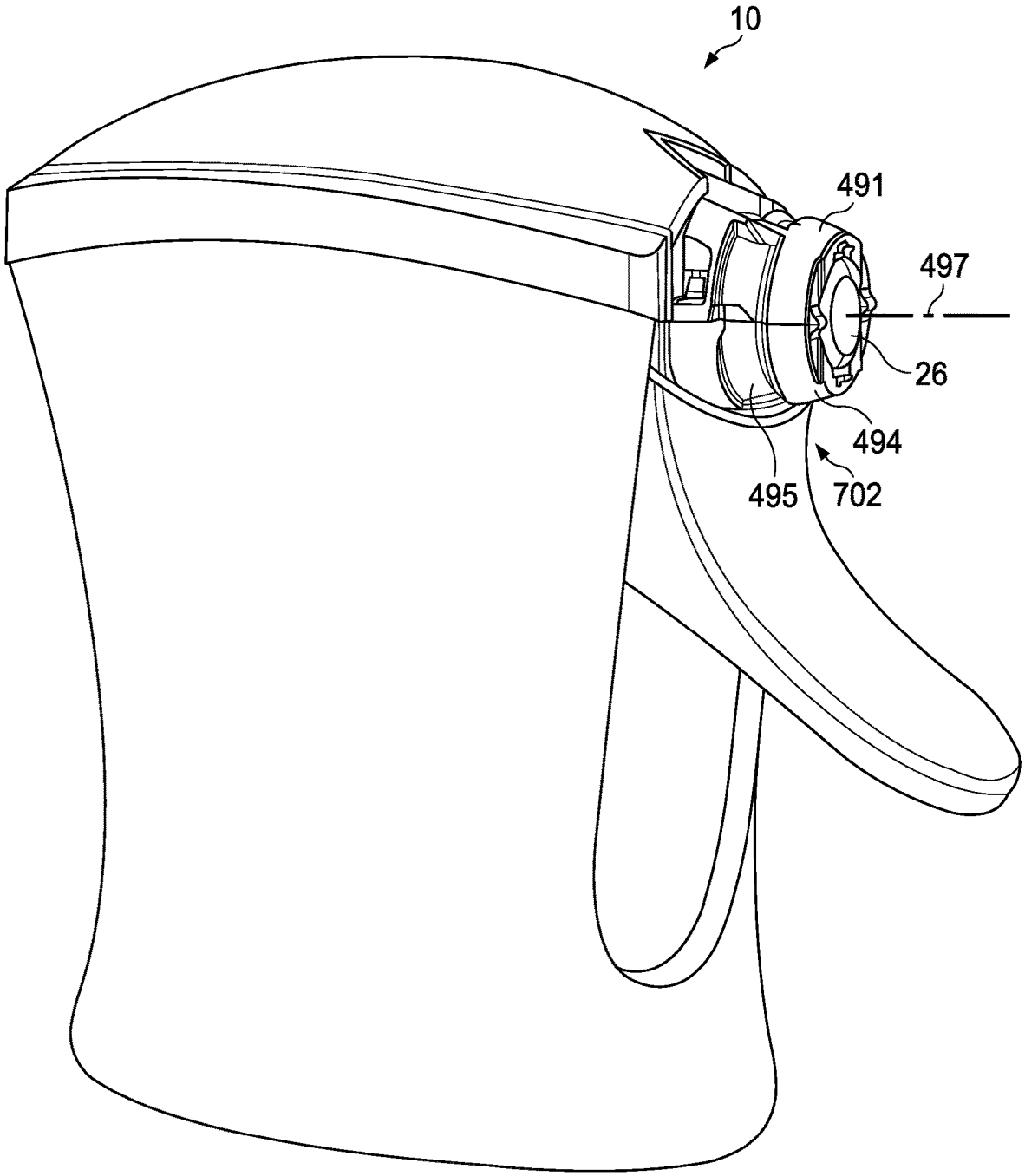
FIG. 7B is a side perspective view of the spray dispenser of FIG. 2 after assembly.

Referring to FIG. 4, the second portion 49 may further comprise a second nozzle housing part 494 arranged with the first nozzle housing part 491 to surround the nozzle 26 circumferentially when the sprayer cover 40 is assembled to the trigger assembly 20 (as shown in FIG. 7B). The second portion 49 may include one or more bearing surfaces 495 for supporting the spout 50. The bearing surface 495 may have an outer surface area configured to support a spout outer surface 501 of the spout 50 such as shown in FIG. 2. The second nozzle housing part 494 may be moveably attached to the first nozzle housing part 491 so as to be movable from a cover first position 701 (as shown in FIG. 7A) to a cover second position 702 (as shown in FIG. 7B) relative to the first nozzle housing part 491 in which the nozzle 26 is partially surrounded. The second nozzle housing part 494 may be rotatably mounted to the first nozzle housing part 491. Referring to FIG. 4, the second portion 49 may comprise at least two flexible hinges 496 connecting the first nozzle housing part 491 and the second nozzle housing part 494. Further, referring to FIG. 5, the second portion 49 may comprise at least one flexible hinge 496 connecting the first nozzle housing part 491 and the second nozzle housing part 494. A technical effect of hinges is they can be molded as a single piece with the cover 40 to define a "living hinge". A "living hinge" is a hinge integral with the two parts it connects.

Further, referring to FIG. 4, the second portion 49 may comprise an interlocking mechanism 400 for locking the second nozzle housing part 494 to the first nozzle housing part 491 in the second position to surround the nozzle 26 (shown in FIG. 7B). For example, the interlocking mechanism 400 may comprise a snap-fit or interlocking joint. In embodiments, the interlocking mechanism may comprise structural features 401, 402 integral with the first nozzle housing part 491 or the second nozzle housing part 494 such as hooks or protrusions on the first nozzle housing part 491 which, after the first and second nozzle housing parts 491, 494 surround the nozzle 26, engage with corresponding undercuts, detents, protrusions, or openings in the first nozzle housing part 491 to lock the second nozzle housing part 494 to the first nozzle housing part 491 to form the nozzle housing 498. In this way, the nozzle housing 498 formed by the second portion 49 protects the nozzle 26 from external damage.

Referring to FIG. 6, the second portion 49 may comprise the first nozzle housing part 491 for surrounding the nozzle 26 where an outer surface area of the bearing surface 495 is smaller relative to the outer surface area of the bearing surface 495 of FIGS. 4 and 5.

Still further, the spray dispenser 10 may comprise one or more cover protrusions 80 disposed on the sprayer cover 40. The one or more cover protrusions 80 may be configured for attaching the sprayer cover 40 to the shroud 30 according to a method of assembly detailed further in the following description with reference to FIGS. 7A and 7B.

Method of Assembly

FIGS. 7A and 7B are side perspective views of the spray dispenser 10 before and after assembly. FIG. 7A shows the sprayer cover 40 in a cover first position 701 and FIG. 7B shows the sprayer cover 40 in a cover second position 702 and attached to the shroud 30. Referring to FIG. 7A, a trigger assembly 20 is inserted into the shroud body 13 of the shroud 30 such that a pump 22 is disposed within the shroud 30 and the nozzle 26 is adjacent to the second open end 302 in the shroud 30 and extending outwardly therefrom. Sprayer cover 40 is positioned over the shroud 30 and may be attached to the shroud 30 by the engagement of the protrusions 80 with the top edge 301 of the shroud 30 or joined by known adhesion methods. Specifically, during assembly of the sprayer cover 40 to the shroud 30, the cover protrusion 80 may be sized to engage the top edge 301 at the second open end 302 in the inner wall 31 to define a point of contact for guiding the sprayer cover 40 into engagement with the top edge 301. The cover protrusion 80 may be configured as a snap-fit for engagement with corresponding undercuts adjacent the top edge 301 to lock the sprayer cover 40 to the shroud 30.

Where the trigger 24 is arranged adjacent the nozzle 26, the trigger 24 may be depressed in a downward direction away from the nozzle 26 before attaching the sprayer cover 40. The method of assembly may comprise:

- positioning the first portion 45 of the unitary sprayer cover 40 to cover at least a portion of the second open end 302 of the shroud 30 and engaging the first portion 45 with the top edge 301 of the shroud 30 so that the first portion 45 of the unitary sprayer cover 40 joins and covers the at least a portion of the second open end 302 and the first nozzle housing part 491 of the second portion 49 is extending from the shroud 30 to at least partially surround the nozzle 26.
- rotating the second nozzle housing part 494 of the second portion 49 to a second position in FIG. 7B and engaging the second nozzle housing part 494 to the first nozzle housing part 491 of the second portion 49 in the second position to define a nozzle housing surrounding the nozzle 26.

A technical effect of rotating the second nozzle housing part 494 as described is that it provides a nozzle housing 498 for the nozzle 26 in a single action step and the nozzle housing 498 also provides a bearing surface 495 (shown in FIG. 7B) for attaching the spout 50. The spout 50 may be attached to the spray dispenser 10 according to the following steps;

aligning the longitudinal axis 500 of the spout 50 with a nozzle housing longitudinal axis 497, rotatably mounting the spout 50 to the nozzle housing 498 through engagement of the spout inner surface 502 with an outer surface of the nozzle housing 498 such as the second portion 49 of the spray cover 40 as shown in FIG. 3.

Figure 7C:
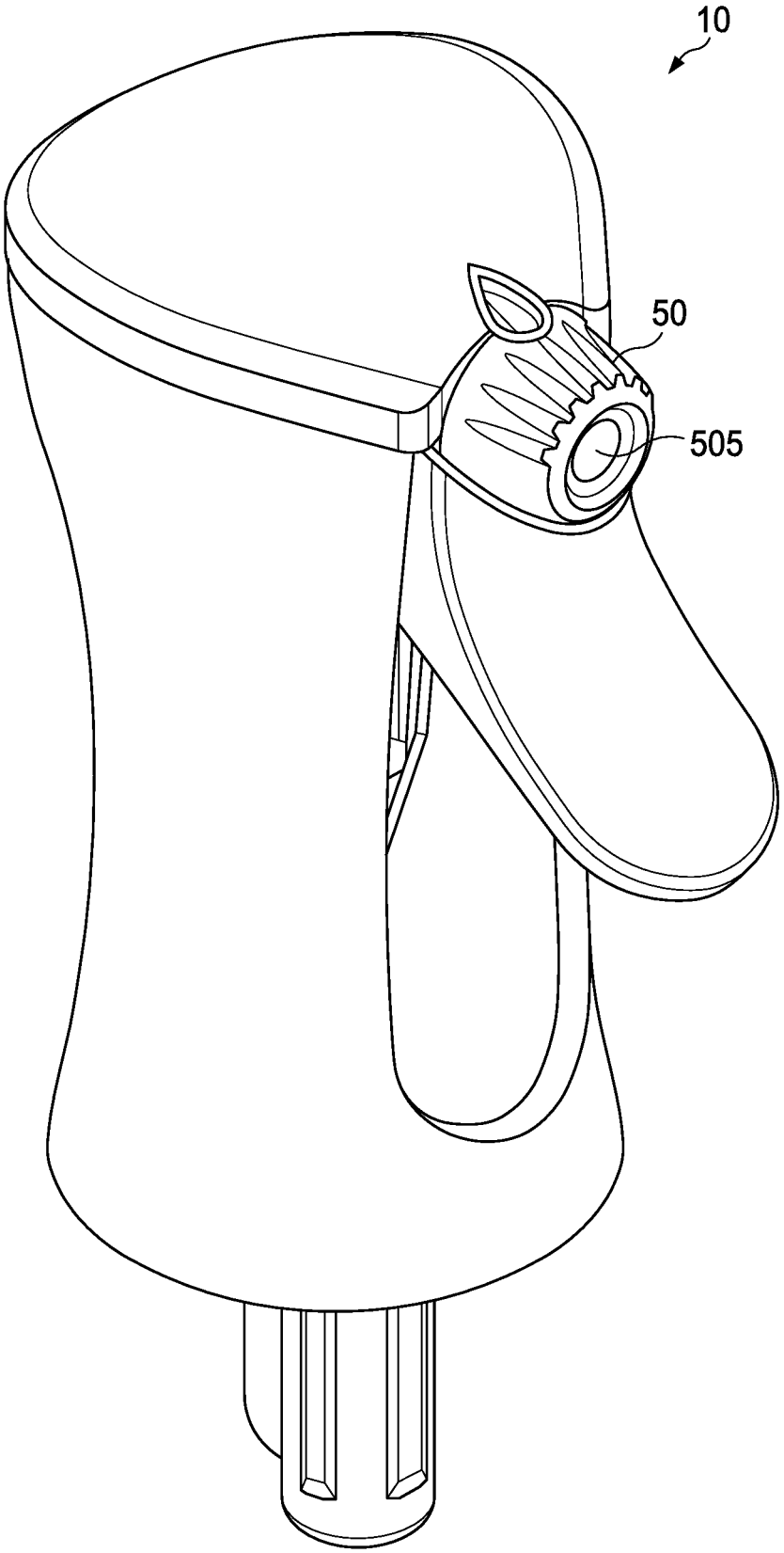
FIG. 7C is a side perspective view of the spray dispenser of FIG. 2 with a spout after assembly.

FIG. 7C is a perspective view of the assembled spray dispenser 10 including the spout 50. The nozzle 26 is aligned with a spout opening 505 to discharge the liquid composition 14 from the container 12 when the spray dispenser 10 is attached to the container 12 filled with the liquid composition 14. A technical effect of providing a bearing surface 495 as described above for the spout 50 is it enables uniform distribution of loading of stresses during rotation of the spout 50 between a discharge unlocked position and a discharge locked position, as detailed further with reference to FIGS. 8, 9A, 9B, and 9C.

Projection and Projection Engaging Surface

Figure 8:
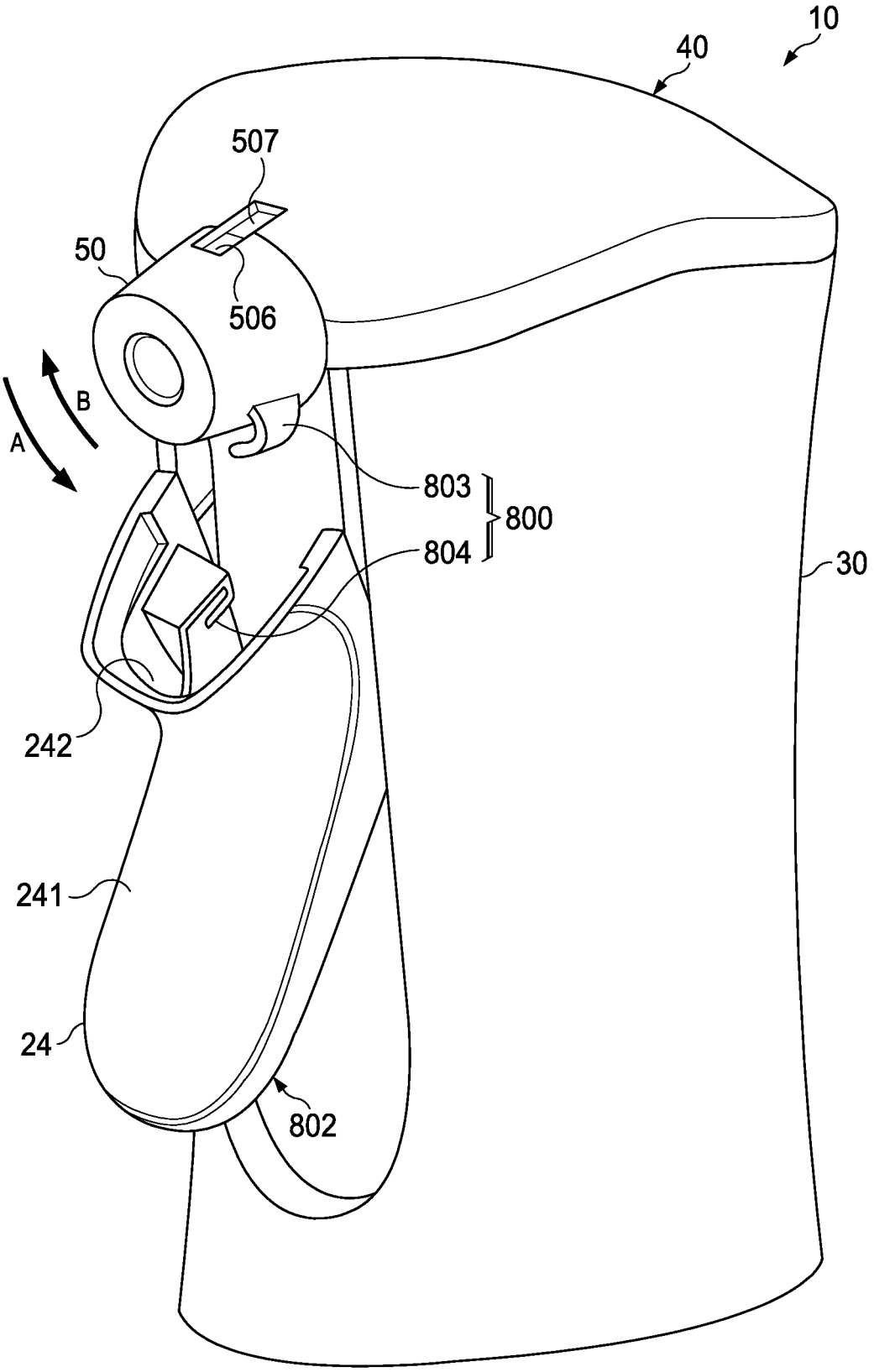
FIG. 8 is a perspective view of a spray dispenser having a trigger and a spout configured for locking the trigger before use according to the present invention.
Figure 9A:
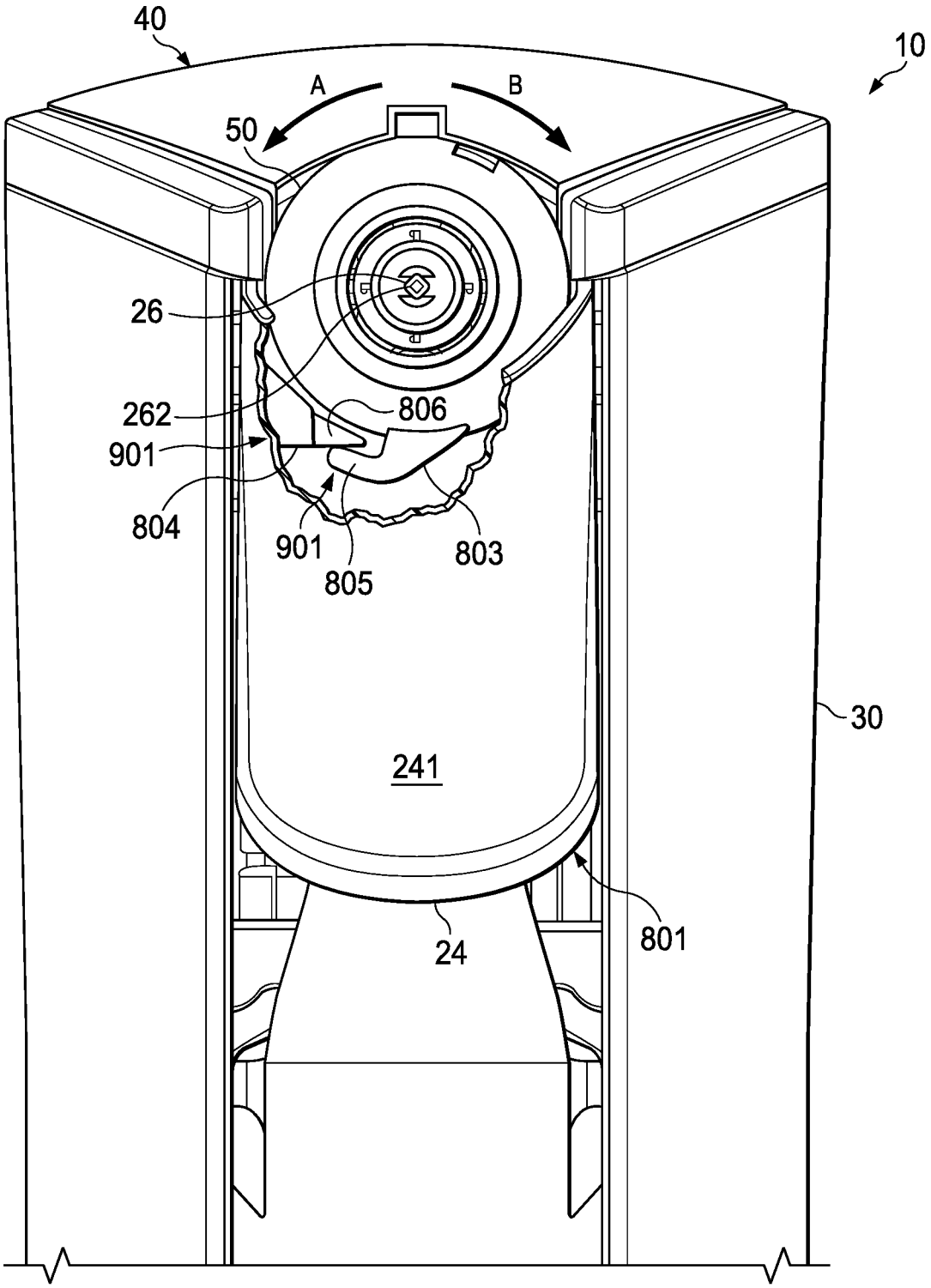
FIG. 9A is a front view of the spray dispenser of FIG. 8 in a first position in which the spout is engaged with a nozzle housing and the trigger is locked.

As shown in FIGS. 8, 9A, 9B and 9C, the spray dispenser 10 may optionally comprise a trigger locking mechanism 800 (hereinafter "locking mechanism") to inhibit actuation of the pump 22. The locking mechanism 800 is preferably a mechanical inhibition of the actuation of the trigger 24. Further, the trigger 24 is movable between a trigger first position 801 (such as shown in FIG. 9A) in which the trigger 24 is relaxed, or is in a state of rest as there is no or substantially no active force being placed on the trigger 24 and a trigger second position 802. To better illustrate the components of the locking mechanism 800, FIG. 8 shows the spray dispenser 10 in the trigger second position 802 in which the trigger 24 is depressed, or is in a state of actuation as the trigger 24 may receive a large enough outside force to depress the trigger 24. The trigger 24 has a trigger front surface 241 and a trigger back surface 242. The locking mechanism 800 may comprise at least a projection 803 and a projection engaging surface 804 for engaging with the projection 803.

The projection 803 may extend outwardly from the spout 50. The projection engaging surface 804 may be disposed on the trigger back surface 242. The projection engaging surface 804 may extend outwardly from the trigger back surface 242. The spout 50 may be configured to be rotatable between a discharge locked position 901 (shown in FIG. 9A) and a discharge unlocked position 902 (shown in FIGS. 9B and 9C). To operate the trigger 24 for use of the spray dispenser 10, the spout 50 may be rotated in a direction A to unlock the trigger 24 and may be rotated in a direction B opposite to the direction A to lock the trigger 24 after use or when the spray dispenser 10 is not in use. To provide a visual indicator of the discharge locked and unlocked positions 901, 902 of the spout 50, the spout outer surface 501 of the spout 50 may include a spout indicator 506 and the sprayer cover 40 may include a cover indicator 507. The spout and cover indicators 506, 507 may be configured as cut-outs of substantially the same shape, or may include colors or surface indicia, or combinations thereof. The projection 803 and the projection engaging surface 804 may engage to create a physical barrier against movement of the trigger 24 as explained below with respect to FIGS. 9A to 9C.

FIG. 9A shows a front view of a spray dispenser 10 having a partial cutout of the trigger 24 so as to see components behind the trigger front surface 241. The spray dispenser 10 is in the trigger first position 801 wherein the trigger 24 is relaxed, or is in a state of rest as there is no or substantially no active force being placed on the trigger 24. In FIG. 9A, the spray dispenser 10 is in a discharge locked position 901 wherein fluid is prevented from being discharged through the nozzle outlet 262 of the nozzle 26. The projection 803 may be rotatably engageable with the projection engaging surface 804. The projection 803 may comprise a hook 805. The projection engaging surface 804 may comprise a tab 806. When the projection 803 and the projection engaging surface 804 are engaged such as for example, through engagement of the hook 805 and the tab 806, the spray dispenser 10 is in the discharge locked position 901, and the trigger 24 is unable to be actuated, or depressed, and as such, the spray dispenser 10 is in the trigger first position 801. The projection 803 may be engaged with the projection engaging surface 804 when the spray dispenser 10 is in the trigger first position 801, as the projection engaging surface 804 is an extension of the trigger back surface 242 and when the spray dispenser 10 is in the trigger first position 801, the projection engaging surface 351 is disposed where the projection engaging surface 804 is capable of engaging with the projection 803.

The spray dispenser 10 may be in the trigger first position 801 and in the discharge locked position 901 when the user first finds the dispensing product on a store shelf and after a user finishes using the dispensing product and desires to keep the spray dispenser 10 from accidentally actuating and discharging fluid, and thus rotates the spout 50 to engage the projection 803 with the projection engaging surface 804 resulting in the discharge locked position 901.

The projection 803 may be disengaged from the projection engaging surface 804 by rotating the spout 50 in a direction A to disengage the projection 803 and the projection engaging surface 804. To engage the projection 803 with the projection engaging surface 804, the spout 50 may be rotated in a direction B.

Figure 9B:
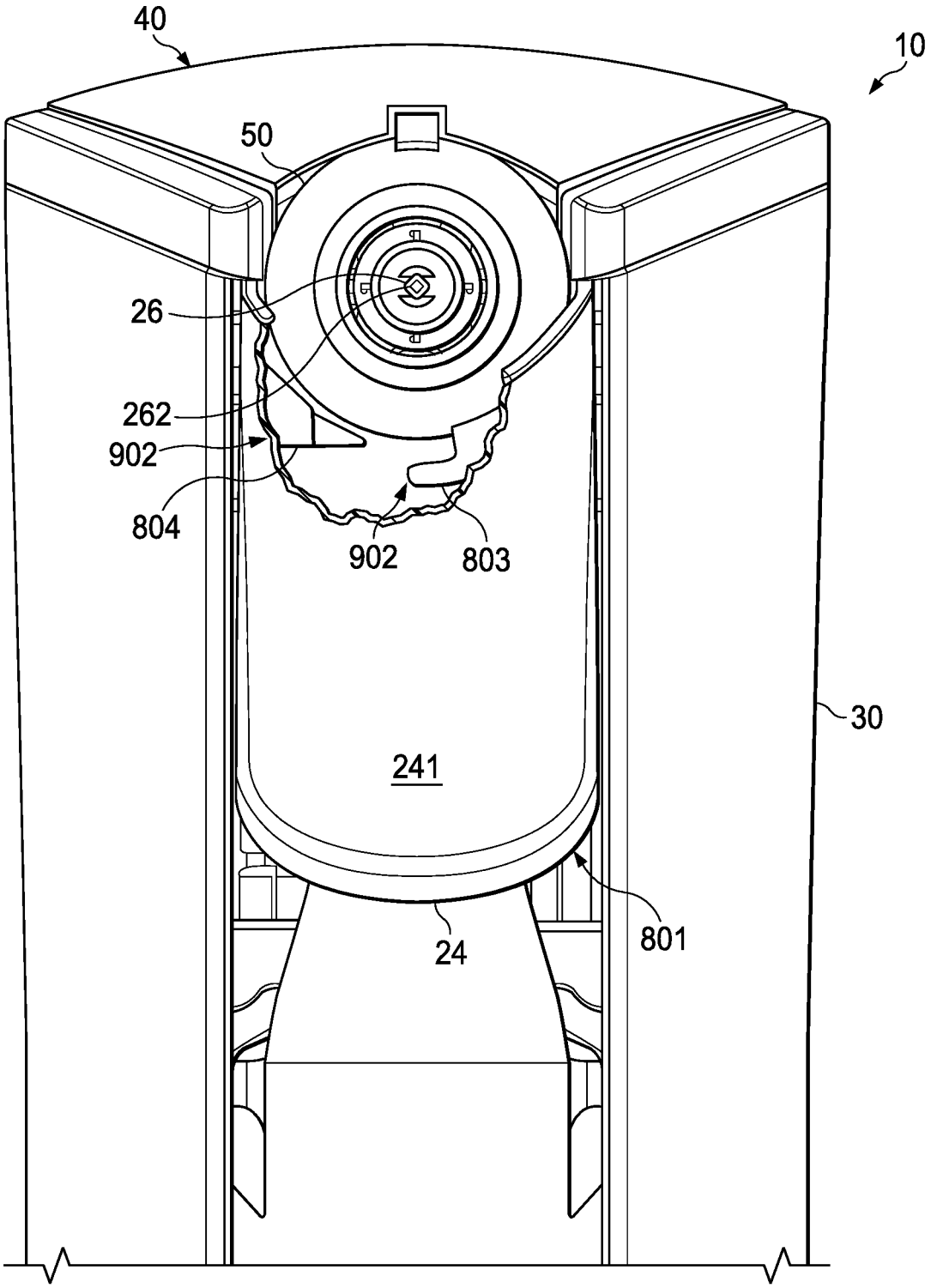
FIG. 9B is a front view of the spray dispenser of FIG. 8 in a second position in which the spout is not engaged with the nozzle housing and the trigger is not locked.

FIG. 9B shows a front view of a spray dispenser 10 where the projection 803 and projection engaging surface 804 are disengaged and the trigger 24 is relaxed, or in the trigger first position 801. In FIG. 9B, the spray dispenser 10 is in a discharge unlocked position 902 wherein fluid may be discharged from the nozzle 26 upon pressing the trigger front surface 241 of the trigger 24.

When the projection engaging surface 804 and the projection 803 are disengaged, the spray dispenser 10 may be in the discharge unlocked position 902, and the trigger 24 is able to be actuated, or depressed, by a sufficient outside force.

Figure 9C:
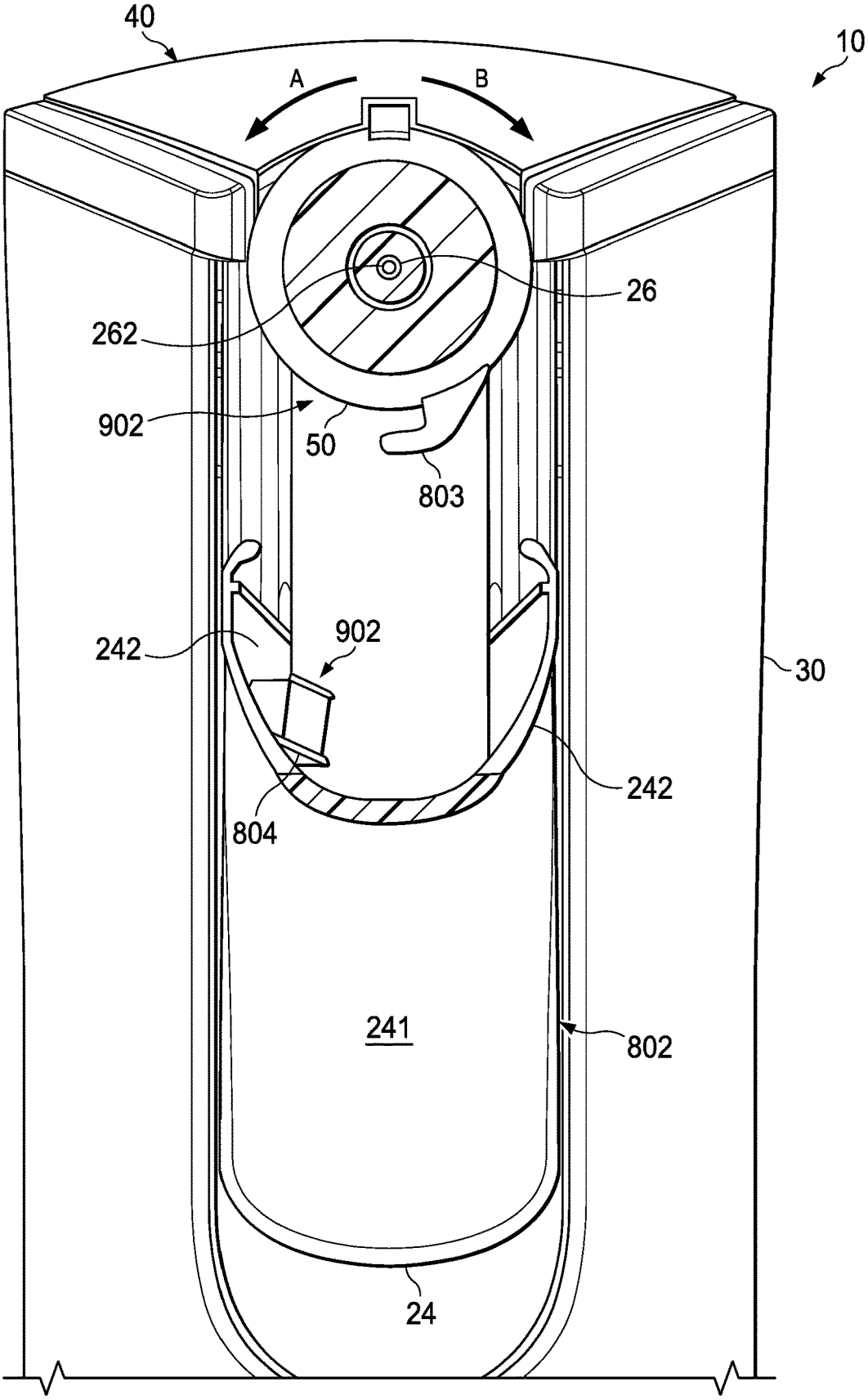
FIG. 9C is a front view of the spray dispenser of FIG. 8 in a third position in which the trigger is depressed for spraying.

When the spray dispenser 10 is in the discharge unlocked position 902, the trigger 24 may be in the trigger first position 801, or relaxed, as shown in FIGS. 9A and 9B, or the trigger 24 may be in the trigger second position 802, or depressed, as further detailed in FIG. 9C.

The trigger 24 of the spray dispenser 10 may be in the trigger first position 801 and in the discharge unlocked position 902 when the user desires to use the liquid dispensing product 1 and first rotates the spout 50 to disengage the projection 803 with the projection engaging surface 804, or to go from the discharge locked position 901 shown in FIG. 9A to the discharge unlocked position 902 shown in FIG. 9B. As the user is first rotating the spout 50 in the direction A, the trigger 24 will be in the trigger first position 801, or relaxed, as the projection 803 and the projection engaging surface 804 are in the process of disengaging, as the trigger 24 cannot be depressed until the projection 803 and the projection engaging surface 804 are disengaged or without damaging the projection 803 and the projection engaging surface 804. The spray dispenser 10 may also be in the trigger first position 801 and in the discharge unlocked position 902 if the user decides not to re-engage the projection 803 and the projection engaging surface 804 after use of the liquid dispensing product 1. When the spray dispenser 10 is in the trigger first position 801 and in the discharge unlocked position 902, the spray dispenser 10 is capable of being accidentally actuated by a sufficient outside force that may come into contact and actuate the trigger 24 to dispense fluid through the nozzle outlet 262 of the nozzle 26. The trigger 24 may be actuated, such as for example by pushing down on the trigger 24.

FIG. 9C shows a partial cross-sectional front view of a spray dispenser 10 taken along the line A-A of FIG. 1 where the projection 803 and the projection engaging surface 804 are disengaged, or in the discharge unlocked position 902, and the trigger 24 is depressed, or actuated. As noted above, the spray dispenser 10 may comprise a trigger second position 802 wherein the trigger 24 is depressed, or is in a state of actuation as the trigger 24 may receive a large enough outside force to depress the trigger 24.

When the spray dispenser 10 is in the discharge unlocked position 902, the trigger 24 may be capable of transitioning from the trigger first position 801, as depicted above in FIG. 9B, to the trigger second position 802, as depicted in FIG. 9C. When the spray dispenser 10 is in the trigger second position 802, the projection 803 and the projection engaging surface 804 are disengaged, or in the discharge unlocked position 512, as when an outside force capable of depressing the trigger 24 is placed on the trigger front surface 241 of the trigger 24, the projection engaging surface 804, as an extension of the trigger back surface 242, may move with the trigger 24, rather than being physically blocked from motion by the projection 803.

The spray dispenser 10 may be in the trigger second position 802 and in the discharge unlocked position 902 when the user is actuating the spray dispenser 10. To actuate the spray dispenser 10, the user first places a force on the trigger 24, commonly by using the user's hand to press down and actuate the trigger 24, and as such the trigger 24 moves to a depressed state, i.e., is in the trigger second position 802. This actuation of the trigger 24 in turn actuates the pump 22 and thus the spray dispenser 10 becomes actuated and liquid may move from within the container 12 of the liquid dispensing product 1 to the spray dispenser 10 to outside of the liquid dispensing product 1 through the nozzle 26.

The sprayer cover 40 may be integral with the shroud body 13 to define a unitary shroud 30. FIG. 10 shows a side perspective view of components of a spray dispenser 10 according to the present invention before assembly. The spray dispenser 10 has a sprayer cover 40, a shroud 30 and a trigger assembly 20. The sprayer cover 40 has substantially the same parts as the sprayer cover 40 of FIG. 4 but differs in that the sprayer cover 40 and the shroud body 13 form a unitary shroud 30. In particular, side walls 42 of the first portion 45 of the sprayer cover 40 extend from the top surface 41 (shown in FIG. 4) of the sprayer cover 40 to define a shroud body 13 for surrounding at least a part of the pump 22 (shown in FIG. 11A).

The trigger assembly 20 has substantially the same components as the trigger assembly 20 of FIG. 2. The trigger assembly 20 may further comprise a screw top neck 210 configured for attaching to a container 12 to form a liquid dispensing product 1 (such as shown in FIG. 1).

Method of Retrofitting

Figure 11A:
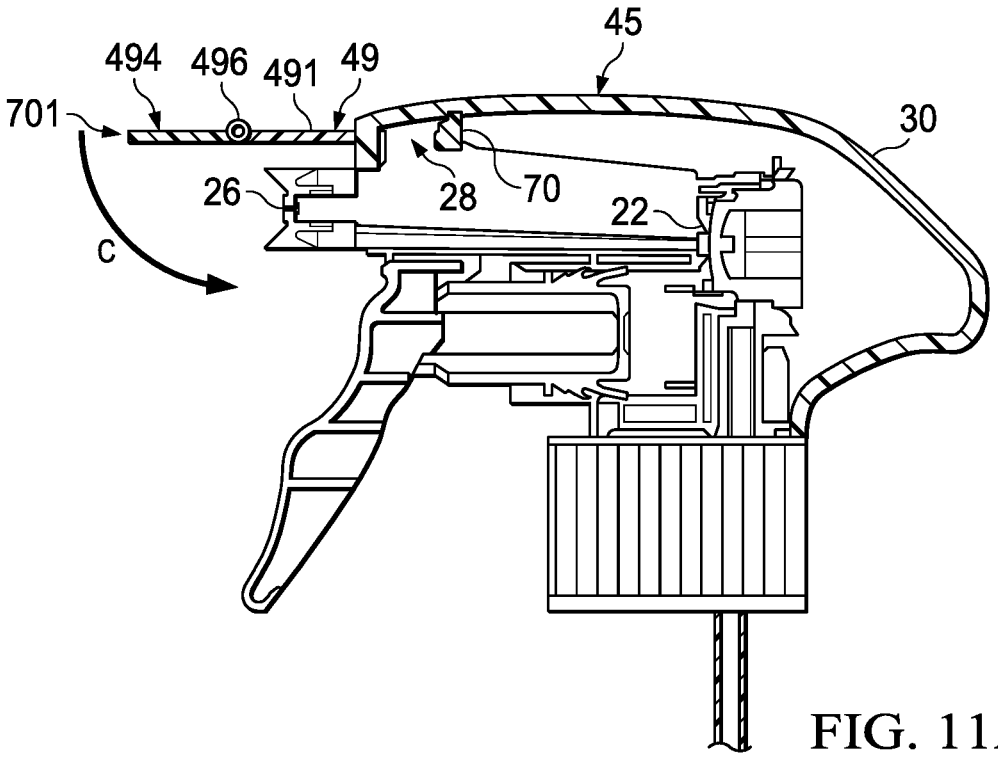
FIG. 11A is a side schematic view of the spray dispenser of FIG. 10 in a first position in which the second nozzle housing part is extending away from the nozzle before assembly.

The present invention also relates to a method of retrofitting a spray dispenser 10. Referring to FIG. 11A, the method comprises attaching the shroud 30 to the trigger assembly 20 by engaging the cover projection 70 extending from the first portion 45 of the sprayer cover 40 with at least a part 28 of the trigger assembly 20. In a cover first position 701 of the sprayer cover 40, the first portion 45 of the sprayer cover 40 is connected to the trigger assembly 20 and the first nozzle housing part 491 of the second portion 49 partially surrounds the nozzle 26 and the second nozzle housing part 494 of the second portion 49 is extending away from the nozzle 26.

Figure 11B:
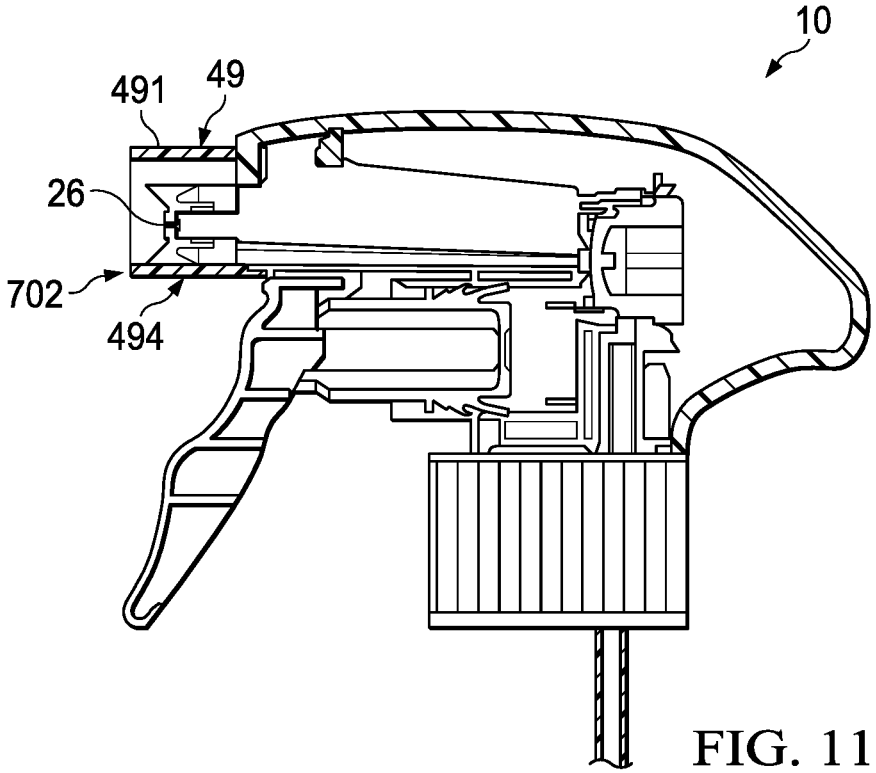
FIG. 11B is a side schematic view of the second nozzle housing part is adjacent to the nozzle after assembly.

The method may further comprise rotating the second nozzle housing part 494 about the flexible hinge 496 connecting the first and second nozzle housing parts 491, 494 in a direction indicated by Arrow C from the first cover position 701 to a cover second position 702 as shown in FIG. 11B.

FIG. 11B is a schematic view of an assembled spray dispenser 10. Referring to FIG. 11B, the second nozzle housing part 494 is adjacent to the nozzle 26 in the cover second position 702 to define a nozzle housing 498 surrounding the nozzle 26. The second nozzle housing part 494 may be engaged to the first nozzle housing part 491 of the second portion 49 in the same way with structural features as shown in the sprayer cover 40 of FIG. 4, and therefore the features are not further described.

Examples are described below:

A. A spray dispenser (10) operably connectable to a container (12) for dispensing fluid from the container (12), the spray dispenser (10) comprising:
- (i) a pump (22),
- (ii) a shroud (30) disposed about at least a portion of the pump (22), the shroud (30) having a shroud bottom edge (33) defining an open end (34);
- (iii) a nozzle (26) in fluid communication with the pump (22), the nozzle (26) adjacent to an opening (305) in the shroud (30) and extending outwardly therefrom; and
- (iv) a unitary sprayer cover (40) having:
  - a first portion (45) spaced apart from the open end (34) of the shroud (30) to define a shroud top (11) of the shroud (30), and
  - a second portion (49) having a proximal end (492) connected to the first portion (45) and a distal end (493) disposed away from the first portion (45); the second portion (49) extending from the first portion (45) to define a nozzle housing (498) at least partially surrounding the nozzle (26), preferably the sprayer cover is integral with the shroud body to define a shroud top.

B. The spray dispenser (10) according to A, wherein the second portion (49) of the unitary sprayer cover (40) comprises a first nozzle housing part (491) and a second nozzle housing part (494) moveably mounted to the first nozzle housing part (491), the second nozzle housing part (494) configured to move from a first position to a second position relative to the first nozzle housing part (491) to define the nozzle housing (498), preferably the second nozzle housing part (494) is rotatably mounted to the first nozzle housing part (492).

C. The spray dispenser (10) according to A or B, wherein the unitary sprayer cover (40) comprises at least one flexible hinge (496), preferably at least two flexible hinges (496) connecting the second nozzle housing part (494) and the first nozzle housing part (491) of the second portion (49).

D. The spray dispenser (10) according to any one of A, B, or C, wherein the unitary sprayer cover (40) comprises an interlocking mechanism (400) for locking the second nozzle housing part (494) to the first nozzle housing part (491) in the second position, the interlocking mechanism (400) preferably comprising one or more structural elements integral with one of: the first nozzle housing part (491) of the second portion (49) and the second nozzle housing part (494) of the second portion (49), wherein the one or more structural elements are configured to engage with corresponding undercuts, detents, protrusions, or openings in the other one of: the first nozzle housing part (491) of the second portion (49) and the second nozzle housing part (494) of the second portion (49) to define snap fits for attaching the second nozzle housing part (494) to the first nozzle housing part (491).

E. The spray dispenser (10) according to any one of A, B, C, or D, further comprising:

a spout (50) having a longitudinal axis (500), a spout outer surface (501) and a spout inner surface (502), the spout (50) is rotatably mounted to the nozzle housing (498) through engagement of the spout inner surface (502) with an outer surface of the nozzle housing (498) to define a bearing surface between the spout (50) and the nozzle housing (498).

F. The spray dispenser (10) according to E, further comprising:

a projection (803) extending outwardly from one of: the trigger back surface (242) and the spout outer surface (501); and a projection engaging surface (804) on the other one of: the trigger back surface (242) and the spout outer surface (501), wherein the projection (803) is aligned to engage or disengage with the projection engaging surface (804) upon rotation of the spout (50) about the longitudinal axis (500); wherein the trigger (24) is configured to be movable between a trigger first position and a trigger second position relative to the shroud (30) when the projection (803) is disengaged with the projection engaging surface (804).

G. A liquid dispensing product (1) comprising a spray dispenser (10) according to any one of A to F, and a container (12) attached to the spray dispenser (10), the container (12) containing a liquid composition (14).

H. A method of assembling a spray dispenser (10) operably connectable to a container (12) for dispensing fluid from the container (12), the method comprising:

(i) providing a shroud (30) having a shroud bottom edge (33) defining a first open end (34) and a shroud top edge (301) defining a second open end (302), a pump (22) disposed within the shroud (30), and a nozzle (26) in fluid communication with the pump (22), the nozzle (26) adjacent to an opening (305) in the shroud (30) and extending outwardly therefrom;

(ii) providing a unitary sprayer cover (40) having:

a first portion (45), and a second portion (49) having a proximal end (492) connected to the first portion (45) and a distal end (493) disposed away from the first portion (45); and (iii) moving the first portion (45) of the unitary sprayer cover (40) towards at least a portion of the second open end (302) of the shroud (30) so that the first portion (45) of the unitary sprayer cover (40) joins and covers the at least a portion of the second open end (302) of the shroud (30), the second portion (49) extending from the shroud (30) to define a nozzle housing (498) at least partially surrounding the nozzle (26), preferably wherein the step (iii) comprises moving the first portion (45) of the unitary sprayer cover (40) in a direction parallel to a longitudinal axis (32) of the shroud (30).

I. The method according to H, wherein the second portion (49) of the sprayer cover (40) comprises a first nozzle housing part (491) and a second nozzle housing part (494) moveably mounted to the first nozzle housing part (491), the second nozzle housing part (494) configured to move from a first position to a second position relative to the first nozzle housing part (491) to define a nozzle housing (498) at least partially surrounding the nozzle (26); the method further comprising the step of:

(iv) moving the second nozzle housing part (494) of the second portion (49) from the first position to the second position to at least partially surround the nozzle (26), preferably wherein the step (iv) comprises rotating the second nozzle housing part (494) of the second portion (49) relative to the first nozzle housing part (491) of the second portion (49).

J. The method according to H or I, wherein the unitary sprayer cover (40) comprises an interlocking mechanism for locking the second nozzle housing part (494) of the second portion (49) in the second position; the method further comprising the step of:

(v) attaching the second nozzle housing part (494) of the second portion (49) to the first nozzle housing part (491) of the second portion (49), preferably wherein the interlocking mechanism comprise one or more structural elements integral with one of: the first nozzle housing part (491) of the second portion (49) and the second nozzle housing part (494) of the second portion (49), wherein the one or more structural elements are configured to engage with corresponding undercuts, detents, protrusions, or openings in the other one of: the first nozzle housing part (491) of the second portion (49) and the second nozzle housing part (494) of the second portion (49) to define snap fits for attaching the first nozzle housing part (491) to the second nozzle housing part (494).

K. The method according to J, further comprising the steps of:

(vi) providing a spout (50) having a longitudinal axis (500), a spout outer surface (501) and a spout inner surface (502);

(vii) aligning the longitudinal axis (500) of the spout (50) with a nozzle housing longitudinal axis (497)

(viii) rotatably mounting the spout (50) to the nozzle housing (498) through engagement of the spout inner surface (502) with an outer surface of the nozzle housing (498) to define a bearing surface (495) between the spout (50) and the nozzle housing L. The method according to K, wherein the spray dispenser (10) comprises a trigger (24) operatively connected to the pump (22), the trigger (24) comprising a trigger front surface (241) facing away from the shroud (30) and a trigger back surface (242) opposed to the trigger front surface (241);

a projection (803) extending outwardly from one of: the trigger back surface (242) and the spout outer surface (502); and a projection engaging surface (804) on the other one of: the trigger back surface (242) and the spout outer surface (502), wherein the projection (803) is aligned to engage or disengage with the projection engaging surface (804) upon rotation of the spout (50) about the longitudinal axis (500);

wherein the trigger (24) is configured to be movable between a trigger first position and a trigger second position relative to the shroud (30) when the projection (803) is disengaged with the projection engaging surface (804);

the method further comprising, prior to step (iv), the steps of;

(ix) applying a pressure to the trigger front surface (241) to move the trigger (24) in at least an axially downward direction from the trigger first position to the trigger second position;

(x) releasing the pressure from the trigger front surface (241) after performing steps (vi) to (viii); and (xi) rotating the spout (50) to engage the projection (803) with the projection engaging surface (804).

M. The method of manufacturing a liquid dispensing product (1) comprising;

(i) providing a spray dispenser (10) according to any one of A, B, C, D, E, F or G;

(ii) providing a spout (50) having a longitudinal axis (500), a spout outer surface (501) and a spout inner surface (502);

(iii) attaching the spout (50) to the spray dispenser (10) by aligning the longitudinal axis (500) of the spout (50) with a nozzle housing longitudinal axis (497);

(iv) rotatably mounting the spout (50) to the nozzle housing (498) through engagement of the spout inner surface (502) with an outer surface of the nozzle housing to define a bearing surface (495) between the spout (50) and the nozzle housing (498);

(v) providing a container (12) with a liquid composition (14); and (vi) attaching the spray dispenser (10) to the container (12) with the liquid composition (14).

N. The method of assembling a spray dispenser (10) of a liquid dispensing product (1), the method comprises;

(i) providing a trigger assembly (20) comprising a trigger (24), a pump (22) operatively connected to the trigger (24), and a nozzle (26) in fluid communication with the pump (22), the nozzle (26) adjacent to an opening (305) in the shroud (30) and extending outwardly therefrom;

(ii) providing a unitary shroud (30) comprising a shroud body (31) and a sprayer cover (40) integral with the shroud body (31), the sprayer cover (40) having;

a first portion (45); and a second portion (49) having a proximal end (492) connected to the first portion (45) and a distal end (493) disposed away from the first portion (45);

(iii) inserting the trigger assembly (20) in the shroud body (31) and attaching the trigger assembly (20) to the first portion (45) of the sprayer cover (40) so that a first nozzle housing part (491) of the second portion (49) of the sprayer cover (40) covers at least a portion of the nozzle (26); and (iv) rotating the second nozzle housing part (494) of the second portion (49) extending from the shroud (30) to define a nozzle housing (498) at least partially surrounding the nozzle (26).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A spray dispenser operably connectable to a container for dispensing fluid from the container, the spray dispenser comprising:

(i) a pump, (ii) a shroud disposed about at least a portion of the pump, the shroud having a shroud bottom edge defining an open end;

(iii) a nozzle in fluid communication with an outlet of the pump, the nozzle adjacent to an opening in the shroud and extending outwardly therefrom;

(iv) a unitary sprayer cover having:

a first portion spaced apart from the open end of the shroud to define a shroud top, and a second portion having a proximal end connected to the first portion and a distal end disposed away from the first portion; the second portion extending from the first portion to define a nozzle housing at least partially surrounding the nozzle;

(v) a spout having a longitudinal axis, a spout outer surface and a spout inner surface, the spout is rotatably mounted to the nozzle housing through engagement of the spout inner surface with an outer surface of the nozzle housing to define a bearing surface between the spout and the nozzle housing;

(vi) a trigger operatively connected to the pump, the trigger comprising a trigger front surface facing away from the shroud and a trigger back surface opposed to the trigger front surface;

(vii) a projection extending outwardly from one of: the trigger back surface and the spout outer surface; and a projection engaging surface on the other one of: the trigger back surface and the spout outer surface, wherein the projection is aligned to engage or disengage with the projection engaging surface upon rotation of the spout about the longitudinal axis; wherein the trigger is configured to be movable between a trigger first position and a trigger second position relative to the shroud when the projection is disengaged with the projection engaging surface.

2. The spray dispenser according to claim 1, wherein the second portion of the unitary sprayer cover comprises a first nozzle housing part and a second nozzle housing part moveably mounted to the first nozzle housing part, the second nozzle housing part configured to move from a first position to a second position relative to the first nozzle housing part to define the nozzle housing.

3. The spray dispenser according to claim 2, wherein the second nozzle housing part is rotatably mounted to the first nozzle housing part.

4. The spray dispenser according to claim 3, wherein the unitary sprayer cover comprises at least one flexible hinge connecting the second nozzle housing part and the first nozzle housing part of the second portion.

5. The spray dispenser according to claim 3, wherein the unitary sprayer cover comprises at least two flexible hinges connecting the second nozzle housing part and the first nozzle housing part of the second portion.

6. The spray dispenser according to claim 2, wherein the unitary sprayer cover comprises an interlocking mechanism for locking the second nozzle housing part to the first nozzle housing part in the second position.

7. The spray dispenser according to claim 6, wherein the interlocking mechanism comprise one or more structural elements integral with one of: the first nozzle housing part of the second portion and the second nozzle housing part of the second portion, wherein the one or more structural elements are configured to engage with corresponding undercuts, detents, protrusions, or openings in the other one of: the first nozzle housing part of the second portion and the second nozzle housing part of the second portion to define snap fits for attaching the second nozzle housing part to the first nozzle housing part.

8. A liquid dispensing product comprising a spray dispenser according to claim 1, and a container attached to the spray dispenser, the container containing a liquid composition.

* * * * *